US007332006B2

(12) United States Patent
Kim et al.

(10) Patent No.: US 7,332,006 B2
(45) Date of Patent: Feb. 19, 2008

(54) VENTILATING AND AIR PURIFYING DEVICE

(75) Inventors: Jeong-Yong Kim, Seoul (KR); Ho Seon Choi, Dongjak-gu (KR); Kwan Ho Yum, Seoul (KR); Gi Seop Lee, Incheon (KR); Ju-Youn Lee, Seoul (KR); Kyung Hwan Kim, Seoul (KR); Baik Young Chung, Incheon (KR)

(73) Assignee: LG Electronics Inc., Seoul (KR)

( * ) Notice: Subject to any disclaimer, the term of this patent is extended or adjusted under 35 U.S.C. 154(b) by 429 days.

(21) Appl. No.: 10/911,513

(22) Filed: Aug. 5, 2004

(65) Prior Publication Data

US 2005/0160706 A1 Jul. 28, 2005

(30) Foreign Application Priority Data

Jan. 28, 2004 (KR) ..... 10-2004-0005433

(51) Int. Cl.
*F25B 29/00* (2006.01)
*F25B 17/04* (2006.01)

(52) U.S. Cl. ..... 55/385.2; 55/481; 55/410; 55/418; 55/472; 96/223; 96/224; 96/226; 454/187; 454/230; 454/234; 454/248

(58) Field of Classification Search ..... 55/385.2, 55/481, 410, 418, 472; 96/223–226; 454/187, 454/230, 234, 248
See application file for complete search history.

(56) References Cited

U.S. PATENT DOCUMENTS 4,537,035 A * 8/1985 Stiles ..... 62/89
5,564,626 A 10/1996 Kettler et al.
5,590,830 A 1/1997 Kettler et al.
5,597,354 A * 1/1997 Janu et al. ..... 454/229
5,707,005 A 1/1998 Kettler et al.

(Continued)

FOREIGN PATENT DOCUMENTS

CA 1320047 7/1993

(Continued)

OTHER PUBLICATIONS

English Language Abstract of JP 9-299742, Nov. 1997.

(Continued)

*Primary Examiner*—Duane Smith
*Assistant Examiner*—Minh-Chau T. Pham
(74) *Attorney, Agent, or Firm*—Greenblum & Bernstein, P.L.C.

(57) ABSTRACT

Ventilating and air purifying device including a case having a blower therein provided to a ceiling or a wall, a first flow passage provided between the blower and a room for making an outdoor, the blower, and the room in communication, a second flow passage for making the room, an inside of the case, and the outdoor in communication, and a damper in the case for isolating the first flow passage from the second flow passage so that room air is discharged to the outdoor and the room air is guided to the blower, or making the first flow passage and the second flow passage in communication so that the room air introduced into the second flow passage is guided to the blower, thereby ventilating and purifying the room air.

23 Claims, 7 Drawing Sheets

U.S. PATENT DOCUMENTS

| | | | | |
|---|---|---|---|---|
| 6,149,698 | A | 11/2000 | Uehara | |
| 6,193,603 | B1 | 2/2001 | Tai | |
| 2004/0020363 | A1* | 2/2004 | LaFerriere et al. | 95/273 |
| 2005/0132681 | A1* | 6/2005 | Chu | 55/471 |
| 2005/0164625 | A1* | 7/2005 | Kim et al. | 454/230 |
| 2006/0174596 | A1* | 8/2006 | Choi et al. | 55/467 |

FOREIGN PATENT DOCUMENTS

| | | |
|---|---|---|
| DE | 4142112 | 6/1993 |
| EP | 0838639 | 4/1998 |
| EP | 1132690 | 9/2001 |
| JP | 62-194133 | 8/1987 |
| JP | 6-101864 | 4/1994 |
| JP | 9-299742 | 11/1997 |
| JP | 2001-165484 | 6/2001 |
| JP | 2001-201134 | 7/2001 |
| JP | 2003-028486 | 1/2003 |
| JP | 2003-097834 | 4/2003 |
| JP | 2004-003744 | 1/2004 |

OTHER PUBLICATIONS

English Language Abstract of JP 2003-028486, Jan. 2003.
English Language Abstract of JP 2004-003744, Jan. 2004.
English Language Abstract of JP 6-101864, Apr. 1994.
English Language Abstract of JP 2003-097834, Apr. 2003.
English Language Abstract of JP 62-194133, Aug. 1987.
English Language Abstract of JP 2001-201134, Jul. 2001.
U.S. Appl. No. 10/911,497 to Kim et al.
English Language Abstract of JP 2001-165484. Jun. 2001.

* cited by examiner

VENTILATING AND AIR PURIFYING DEVICE

This application claims the benefit of the Korean Application No. P2004-5433 filed on Jan. 28, 2004, which is hereby incorporated by reference.

BACKGROUND OF THE INVENTION

1. Field of the Invention

The present invention relates to air purifiers, and more particularly, an air purifier having a ventilating function.

2. Background of the Related Art

The air purifier draws air from a room, removes foreign matter from the air, and supplies cleaned air to the room. As air pollution becomes intense, and living standard becomes higher, the air purifiers are gradually come into wide use recently. Such purifiers are provided in a form of packages, and the user places the air purifier on a floor of a room.

However, the air purifier placed on the floor can not remove dust flying in the room air, effectively.

Moreover, because the air purifier draws only room air, removes dust from the room air, and supplies the air to the room again, oxygen content of the room drops, and carbon dioxide content of the room rises as operation time period of the air purifier passes by. Accordingly, in order to prevent this, there has been inconvenience of opening a window to ventilate room air.

If it is desired to ventilate the room automatically, it is required to install separate ventilating equipment at the building, to require much installation cost, and maintenance cost.

In the meantime, the air purifier placed on the floor is liable to go wrong or fall due to children.

SUMMARY OF THE INVENTION

Accordingly, the present invention is directed to a ventilating and air purifying device that substantially obviates one or more of the problems due to limitations and disadvantages of the related art.

An object of the present invention is to provide an air purifier having a ventilating function, which can remove dust from room air effectively, and ventilate a room.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the ventilating and air purifying device includes a case having a blower therein provided to a ceiling or a wall, a first flow passage provided between the blower and a room for making an outdoor, the blower, and the room in communication, a second flow passage for making the room, an inside of the case, and the outdoor in communication, and a damper in the case for isolating the first flow passage from the second flow passage so that room air is discharged to the outdoor and the room air is guided to the blower, or making the first flow passage and the second flow passage in communication so that the room air introduced into the second flow passage is guided to the blower.

The first flow passage is preferably bent within the case such that a flow direction of the air entering into the case and a flow direction of the air supplied to the room differ.

The second flow passage is bent within the case such that a flow direction of the air entering into the case and a flow direction of the air discharged to the outdoor differ.

In other aspect of the present invention, there is provided a ventilating and air purifying device including a case provided to a ceiling or a wall having an inlet, and an outlet in communication with a room, an air supply duct, and an air discharge duct for making an outdoor and the case in communication respectively, a blower in the case for forcing the air introduced into the case to move toward the outlet, a filter in the case for purifying the air supplied to the room through the outlet, a guide duct in the case for guiding the air introduced into the case to the blower, and a damper in the case for isolating the inlet and the outlet from the guide duct, or making the inlet in communication with the guide duct.

Preferably, at least one of the air supply duct, and the air discharge duct is connected to a surface adjacent to a surface having the inlet and the outlet formed therein.

Preferably, the air discharge duct is provided to draw air between the inlet and the guide duct.

Preferably, the damper is provided to open/close a part of the guide duct in communication with the inlet.

The device further includes a valve provided to at least one of the air supply duct and the air discharge duct for opening/closing the air supply duct or the air discharge duct.

The device further includes a conductive heat exchanger which makes the air supply duct and the air discharge duct to cross for indirect heat exchange of air flowing in the air supply duct and the air discharge duct.

The device further includes at least one branch duct branched from at least one of the air supply duct and the air discharge duct in communication with the room.

Preferably, the blower draws air in an axial direction, and discharges in a radial direction.

The device further includes a sensor fitted to the case for measuring carbon dioxide content of the room air.

The device further includes a sterilizing part provided to the case for sterilizing the air supplied to the room. The sterilizing part includes at least one of an ion generator, a UV lamp, and a terpene generator.

The device further includes an oxygen generator provided to the case for supplying oxygen to the air supplied to the room.

The device further includes an aroma device provided to the case for emitting aroma to the air supplied to the room.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings;

FIGS. 2A~3B illustrate diagrams each showing an air purifier in accordance with a first preferred embodiment of the present invention; wherein FIGS. 2A and 2B respectively illustrate a section, and a perspective view of the air purifier when the air purifier is operated in an air purifying mode;

FIGS. 3A and 3B respectively illustrate a section, and a perspective view of the air purifier when the air purifier is operated in a ventilating mode;

DETAILED DESCRIPTION OF THE PREFERRED EMBODIMENT

Reference will now be made in detail to the preferred embodiments of the present invention, examples of which are illustrated in the accompanying drawings. In describing embodiments of the present invention, same parts will be given the same names and reference symbols, and repetitive description of which will be omitted.

Figure 1:
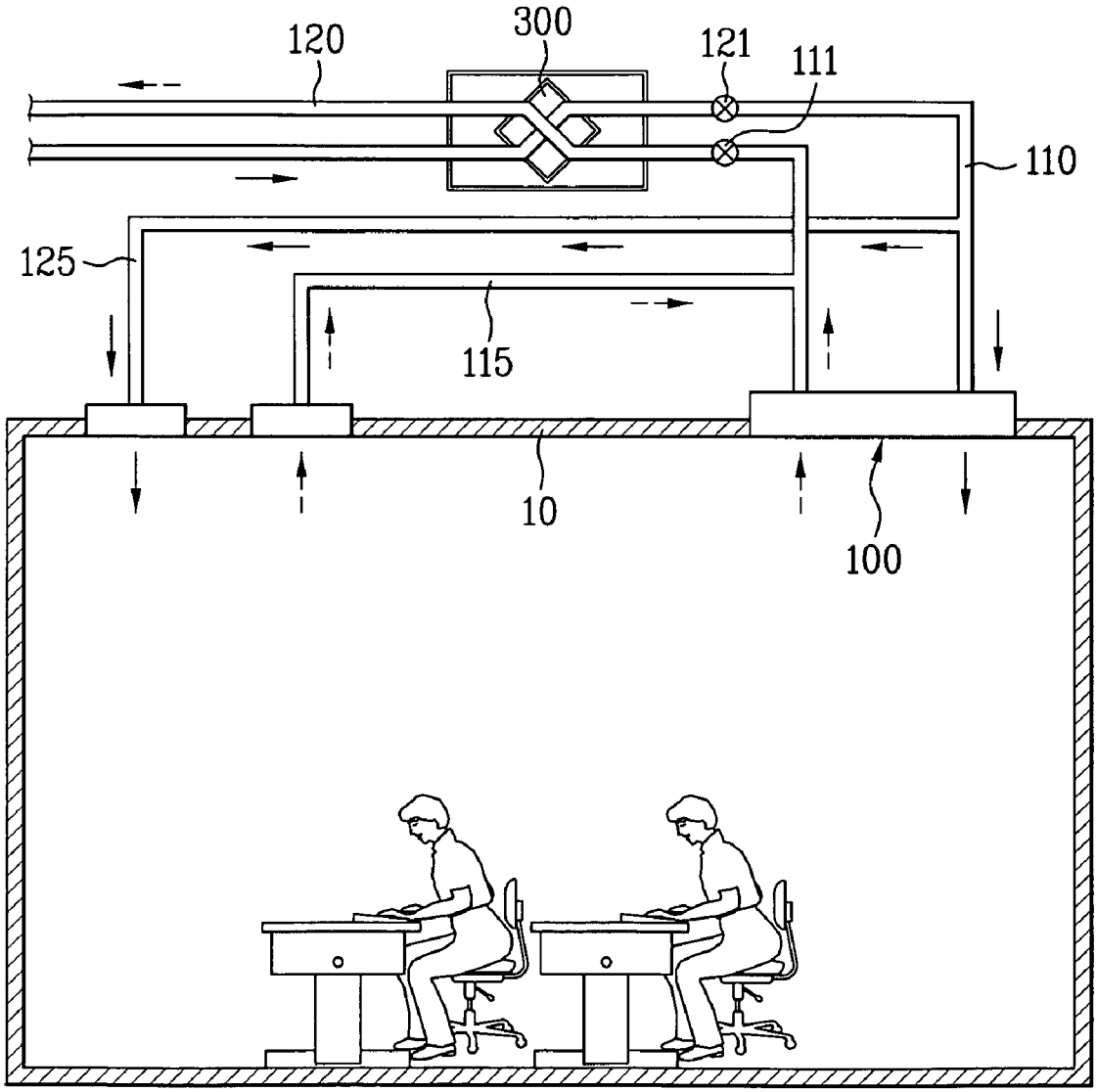
FIG. 1 illustrates a diagram showing an air purifier in accordance with a preferred embodiment of the present invention installed at a room, schematically.

Referring to FIG. 1, the air purifier 100 is provided, not in a package form, but in a built-in form. That is, different from the related art air purifier having a case installed in a room, the air purifier of the present invention has a case 101 installed on a ceiling 10, or though not shown, mounted on a wall.

The case 101 has at least one face in contact with the room. The face of the case 101 in contact with the room has an inlet 130, and an outlet 140 in communication with the room. As shown in FIGS. 2A~6, the case 101 has a blower 150 therein.

The blower 150 has a motor 151, and a fan 152. It is preferable that the fan 152 draws air in an axis direction, and discharges in a radial direction. This structure enables to divert an air flow direction within the case 101, permitting to change arrangement of various components that are required to be arranged according to the air flow direction. Therefore, by reducing a height and a thickness of the case 101, the case 101 can be made compact.

In the meantime, the air purifier 100 has two flow passages that pass through the case 101, one of which is a first flow passage for introducing outdoor air into the case 101, cleaning the outdoor air, and supplying the air into the room, and the other one of which is a second flow passage for discharging room air to an outside of the room through the case 101. As the first flow passage and the second flow passage are provided thus, the air purifier 100 of the present invention is able, not only to clean the room air, but also to ventilate the room with the outdoor air. The first, and second flow passages will be described in detail with reference to FIG. 2A.

Figure 2A:
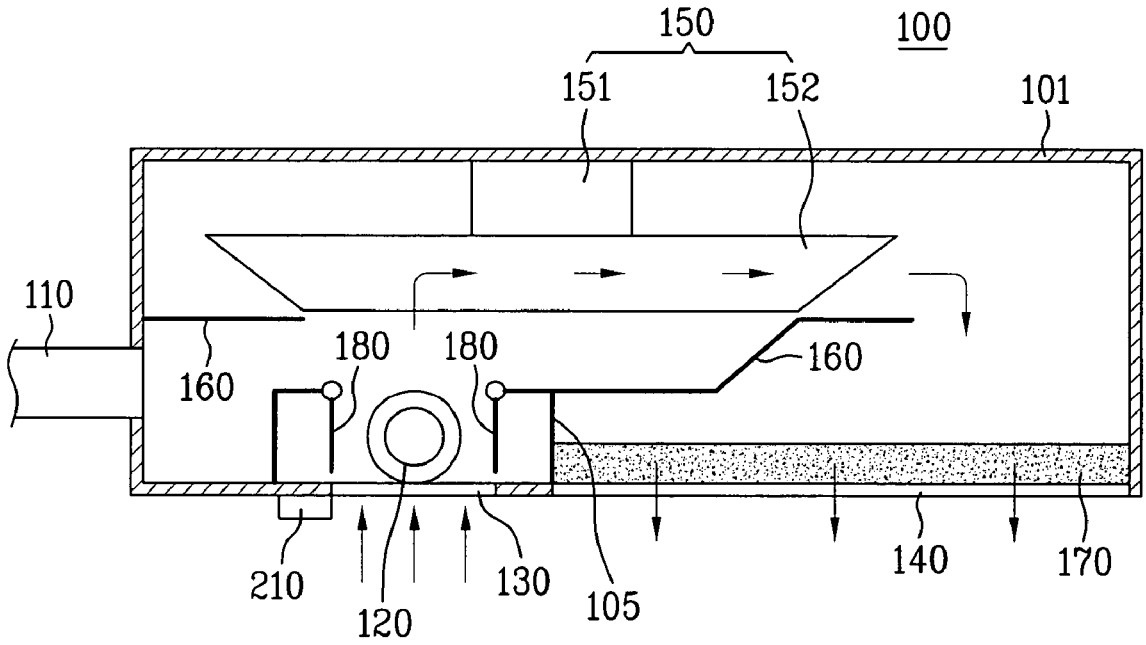

The first flow passage makes outdoor, the blower 150, and the room in communication. For an example, as shown in FIG. 2A, the first flow passage includes an air supply duct 110, a guide duct 160, an inside of the case 101, and the outlet 140.

The air supply duct 110 has one end connected to a surface of the case 101, particularly, a surface adjacent to a surface the inlet 130 and the outlet 140 formed therein, to make the outdoor in communication with the inside of the case 101. Though not shown, the air supply duct 110 may has a fan for forcing outdoor air to move toward the case 101.

The guide duct 160 has one end in communication with the air supply duct 110, and the other end in communication with the fan 152 of the blower 150. The fan 152 is in communication with the inside of the case 101 which is in communication with the outlet 140. Accordingly, the outdoor air introduced into the case 101 through the air supply duct 110 is supplied to the room through the outlet 140 via the guide duct 160, the fan 152, and the case 101.

The first flow passage provided thus is bent within the case 101. This structure enables to divert a flow direction of the air entering into the case 101, to enable change of arrangement of various components required to arrange along the flow direction of air in the case 101, leading to make the case 101 compact by reducing the height and thickness of the case 101.

In the other hand, for purifying the air supplied to the room, a filter 170 is provided in the first flow passage between the blower 150 and the room. In more detail, the filter 170 is provided inside of the case 101, particularly in a space between the fan 152 and the outlet 140. As shown in FIG. 2A, the filer 170 may be provided to cover the outlet 140.

Once the filter 170 is provided thus, all foreign matters contained in the outdoor air introduced into the case 101 through the air supply duct 110 is removed, to supply purified air to the room.

The second flow passage makes the room, the inside of the case 101, and the outdoor in communication. For an example, as shown in FIG. 2A, the second flow passage includes the inlet 130, the inside of the case 101, and an air discharge duct 120.

Referring to FIG. 2A, the inlet 130, in communication with the room, may be arranged side by side with the outlet 140. In this case, it is preferable that the inlet 130 and the outlet 140 are separated by a partition plate 105 connected between the case 101 and the guide duct 160.

The air discharge duct 120 is provided to make the inside of the case 101 and the inlet 130 in communication. Though not shown, there may be a fan inside of the air discharge duct 120 for forcing the room air introduced into the inside of the case 101 through the inlet 130 to move toward the outdoor.

The discharge duct 120 is provided to a surface adjacent to a surface of the case 101 having the inlet 130 and the outlet 140 formed therein. The aid discharge duct 120 is provided to draw air between the inlet 130 and the guide duct 160.

Once the air discharge duct 120 is connected to the case 101 thus, the room air introduced into the inside of the case 101 through the inlet 130 is discharged to outdoor through the air discharge duct 120. In this instance, the air introduced into the inside of the case 101 through the inlet 130 is separated by the partition plate 105 from, and does not mix with, the air discharged to the room from the inside of the case 101 through the outlet 140.

Once the second flow passage is provided thus, the second flow passage has a bent form within the case 101. This structure diverts an air flow direction within the case 101, to enable, as described before, change of arrangement of various components to be arranged following the air flow direction within the case 101, leading to make the case 101 compact by reducing a height or a thickness of the case 101.

Once the case 101 having the blower 150, and the air purifier 100 having the first, and second flow passages are provided, purified air can be supplied to the room through the first flow passage, and polluted air can be discharged to outdoor through the second flow passage. According to this, the air purifier 100 of the present invention can perform, not only an air purifying function, but also a ventilating function, at the same time.

In the meantime, the air purifier 100 has a damper 180 for controlling flow passage of room air or outdoor air introduced into the case 101 further provided thereto. The damper 180 is in the case 101, for making the first, and second flow passage to be in communication or isolation, selectively.

In more detail, the damper 180 either isolates the first flow passage and the second flow passage for discharging room air to outdoor, and guiding outdoor air to the blower 150, or makes the first, and second flow passages in communication for guiding room air introduced into the second flow passage to the blower 150. The damper 180 will be described in more detail, with reference to the attached drawings.

The damper 180 is provided to a part of the first flow passage in contact with the second flow passage, such that the damper 180 can open/close a part of the first flow passage. That is, as shown in FIG. 2A, the damper 180 is provided to a part of the guide duct 160 in communication with the inlet 130, for opening/closing a part of the guide duct 160.

This structure enables makes the inlet 130 and the guide duct 160 in communication when a part of the guide duct 160 is opened, to make the first flow passage and the second flow passage in communication at the end.

In this case, the room air introduced into the inside of the case 101 through the inlet 130 is guided to the blower 150 by the damper 180, and, therefrom, to the room. According to this, the room air is purified by the air purifier 100, and supplied to the room.

In this instance, the outdoor air can be introduced into the case 101 through the air supply duct 110, and the room air can be discharged to outdoor through the air discharge duct 120. Therefore, for preventing this, it is preferable that the fans in the air supply duct 110, and the air discharge duct 120 are stopped, respectively.

Figure 3A:
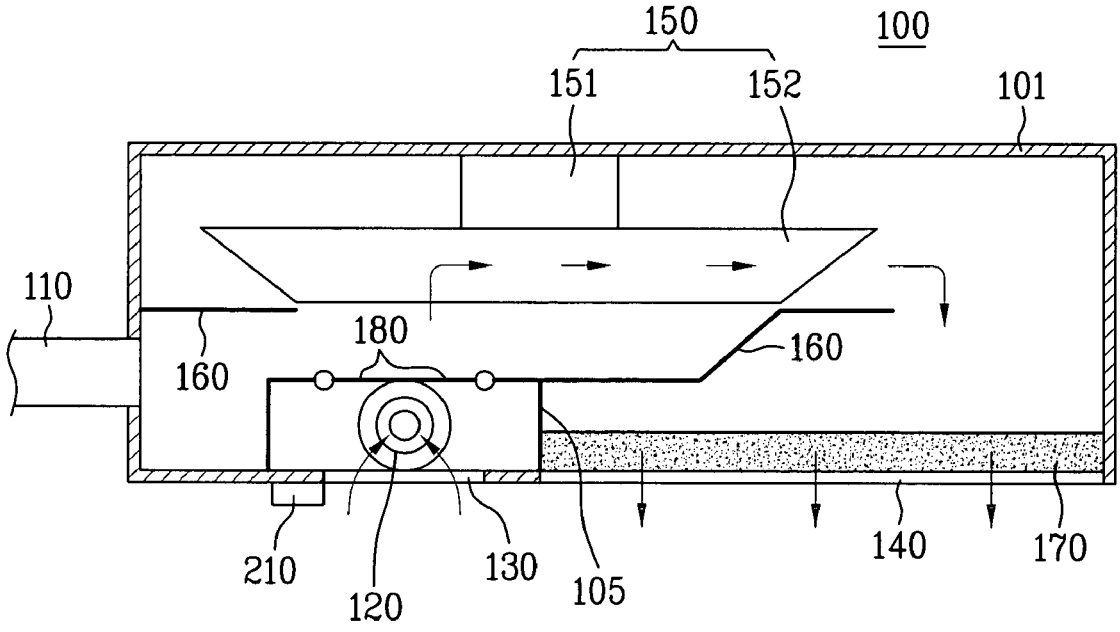

Opposite to this, as shown in FIG. 3A, when the damper 180 closes a part of the guide duct 160, the inlet 130 and the air discharge duct 120 are isolated from the guide duct 160, to isolate the first flow passage from the second flow passage, at the end.

In this case, the room air introduced into the case 101 through the inlet 130 is guided to the air discharge duct 120, and the outdoor air introduced into the case 101 through the air supply duct 110 is guided to the blower 150, purified, and supplied to the room.

In this case, it is preferable that all the fans in the air supply duct 110, and the air discharge duct 120 are put into operation for smooth flow of air through the air supply duct 110, and the air discharge duct 120.

Referring to FIG. 1, there may be valves 111, and 121 provided to at least one of the air supply duct 110 and the air discharge duct 120, for opening/closing the air supply duct 110, or the air discharge duct 120. In this case, by opening/closing the valves 111, and 121, air flow through the air supply duct 110, or the air discharge duct 120 can be permitted or prevented.

Once the damper 180 is provided to the air purifier 100 thus, both purification and supply of room air only to the room again without introduction of outdoor air, and ventilation and supply of purified air to the room are available. According to this, the air purifier can be used effectively.

In the meantime, the air purifier 100 may have a conductive heat exchanger 300 further provided thereto. As shown in FIG. 1, the conductive heat exchanger 300 makes the air supply duct 110 and the air discharge duct 120 to cross, for indirect heat exchange between the outdoor air and the room air flowing through the air supply duct 110 and the air discharge duct 120, respectively.

Once the conductive heat exchanger 300 is provided, the outdoor air heat exchanges with the room air, before the outdoor air is supplied to the room. According to this, if there is a great temperature difference between a room temperature, and an outdoor temperature, the conductive heat exchanger 300 can prevent rapid change of the room temperature, effectively.

Moreover, the energy transfer from the room air discharged to outdoor to the outdoor air supplied to the room can prevent waste of energy effectively in a case the air purifier 100 is applied to an air conditioner that heats or cools the room.

Referring to FIG. 1, the air purifier 100 of the present invention may have at least one branch duct branched at least one of the air supply duct 110 and the sir discharge duct 120, and in communication with the room.

The branch ducts 115, and 125 enable application of the air purifier 100 to a building having a plurality of rooms. Of course, in this case, a plurality of the air purifiers 100 can be installed in one building. For an example, the air purifiers 100 are provided to a bed room, and a living room respectively, and the branch ducts 115, and 125 may be lead to a bath room and a dining room.

Referring to FIG. 2A, the air purifier 100 may have a sensor 210 for measuring content of carbon dioxide further provided thereto. The sensor 210 is attached to a surface of the case 101 in contact with the room, such as in the vicinity of the inlet 130.

The sensor 210 is electrically connected to the control part (not shown) of the air purifier 100, for sensing content of carbon dioxide in the room air and transmitting to the control part. Because the sensor for measuring content of carbon dioxide in air is known widely, no more description will be given.

Once the sensor 210 is provided thus, the control part can determine if the room is ventilated, or only the room air is purified, and supplied to the room again, with reference to the carbon dioxide content in the room air.

Figure 2B:
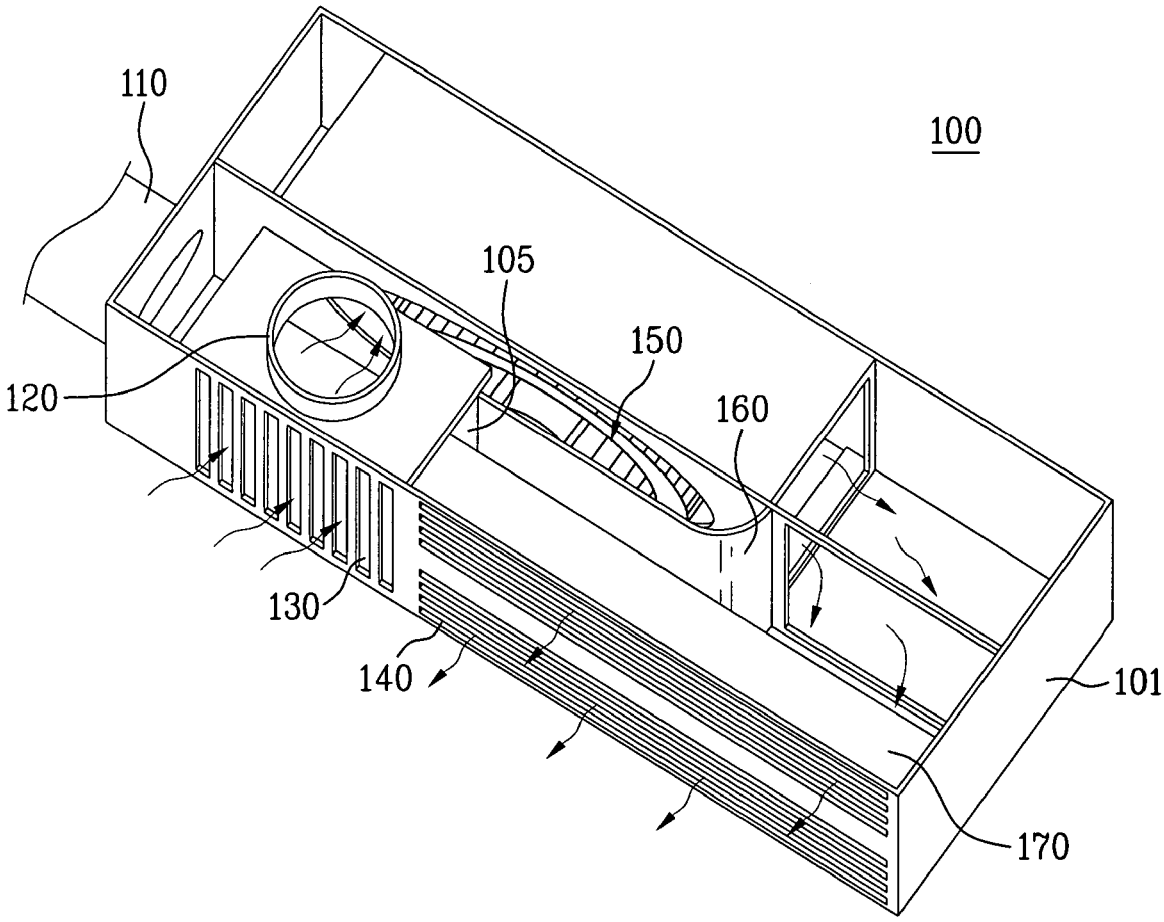

For example, as shown in FIG. 2A or 2B, if the carbon dioxide content of the room air is high, the control part controls the damper 180, and the valve 111, and 121, to introduce outdoor air into the room, and discharge room air to outdoor.

Figure 3B:
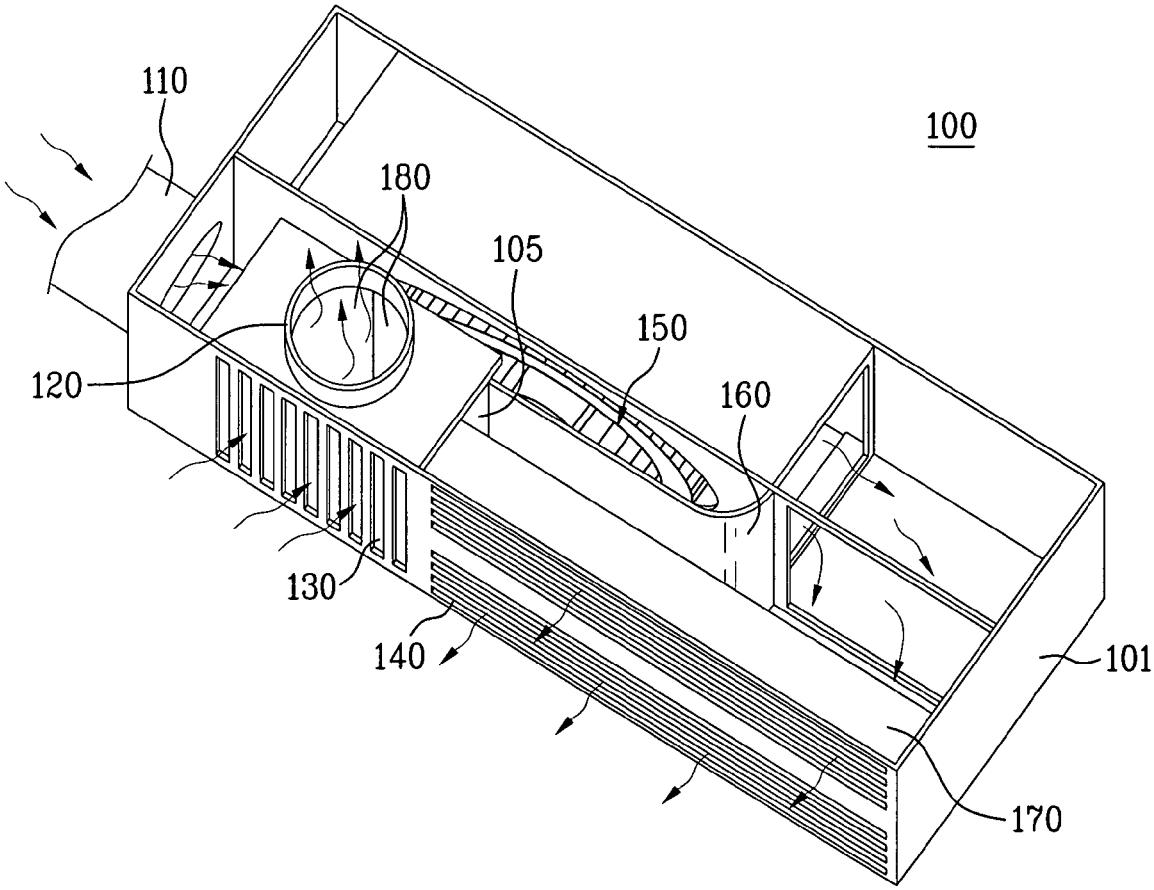

Opposite to this, as shown in FIG. 3A or 3B, if the carbon dioxide content of the room air is low, the control part controls the damper 180, and the valve 111, and 121, to keep purifying the room air, and supply to the room.

However, the air purifier 100 of the present invention is not limited to this. That is, the carbon dioxide content of the room air measured by the sensor 210 displays to an outside, so that the user can operate the air purifier 100 manually with reference to the carbon dioxide content.

In the meantime, the air purifier 100 may have a sterilizing part further provided thereto. The sterilizing part is provided to the case 101, for sterilizing air to the room, for removal of microbes and bacteria from the air. The sterilizing part may include at least one an ion generator 230, a UV lamp 220, and a terpene generator 240, which will be described with reference to FIGS. 4 and 6.

Figure 4:
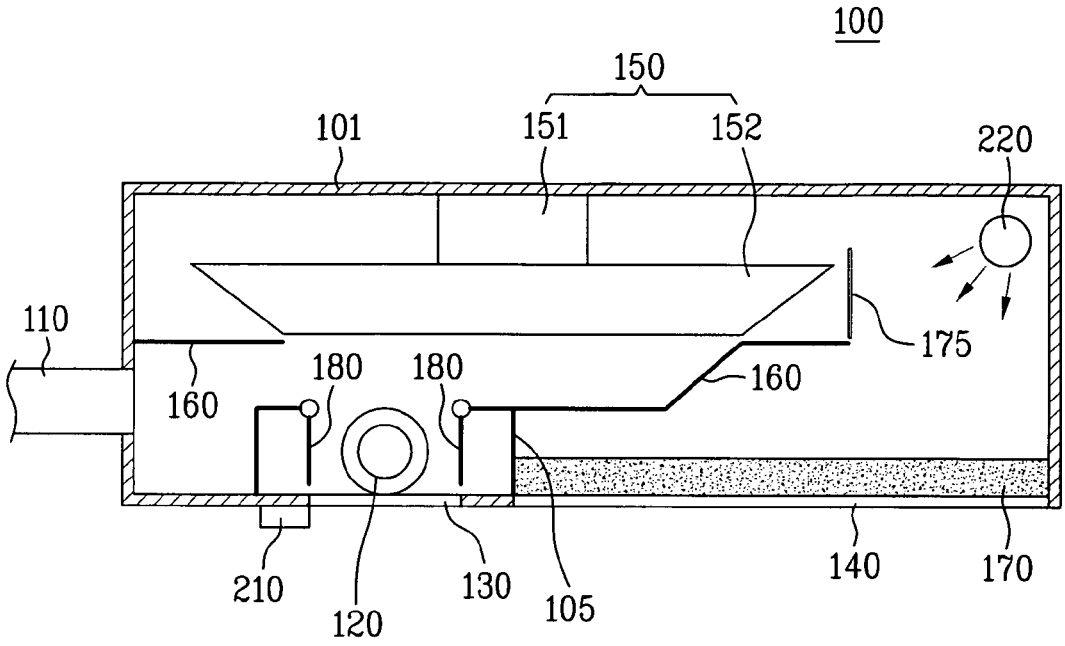
FIG. 4 illustrates a section of an air purifier in accordance with a second preferred embodiment of the present invention, schematically.

Referring to FIG. 4, the UV lamp 220 is provided to the case 101, for directing a UV beam between the fan 152 and the outlet 140, for sterilizing the air. Since the sterilizing effect of the UV beam is already known widely, and the UV lamp emitting the UV beam is already used widely for sterilizing, further description of a system of the UV lamp 220 will be omitted.

In the meantime, the unexplained reference symbol 175 in FIG. 4 denotes a pre-filter between the filter 170 and the fan 152, for removal of relatively large sized foreign matters from the air.

Figure 5:
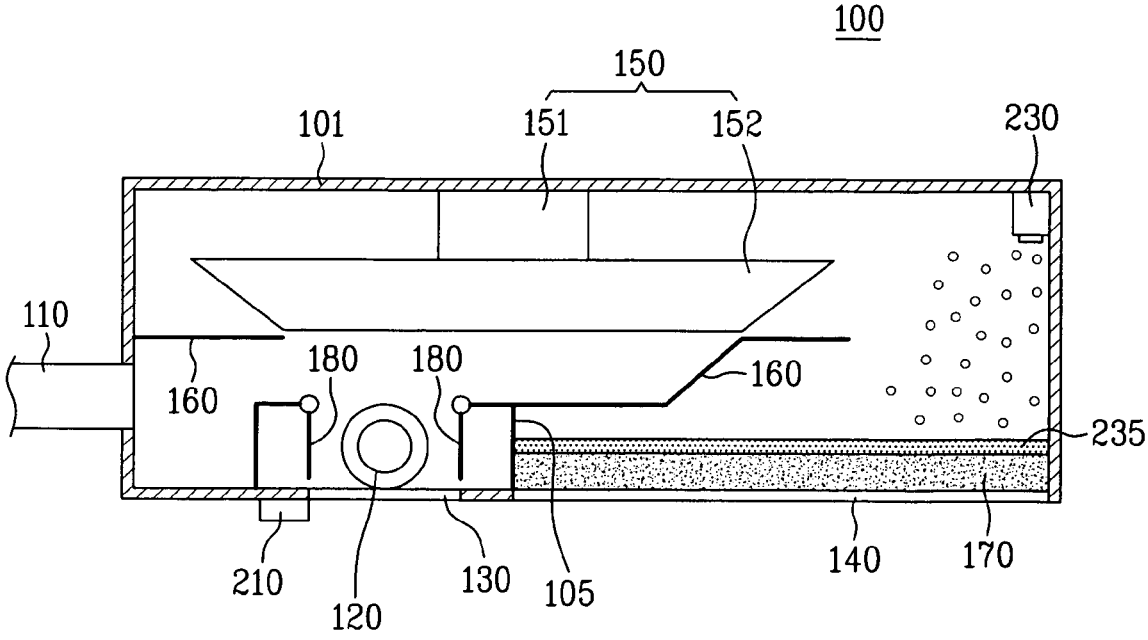
FIG. 5 illustrates a section of an air purifier in accordance with a third preferred embodiment of the present invention, schematically.

Referring to FIG. 5, the ion generator 230 is provided to the case 101. The ion generator 230 emits anions to a space between the fan 152 and the outlet 140, for sterilizing the air supplied to the room. Such an ion generator 230 is used widely, one example of which will be described.

For an example, if a pointed needle is charged with a high voltage, oxygens $O_2$ in the vicinity of the point becomes ozone $O_3$ having one more oxygen atom. The ozone is known to have an excellent oxidizing sterilizing capability, and a sterilizing effect. Moreover, the ozone joins with contaminants, such as positive ion particles, which are attached to a dust collecting plate, if provided, to give an air purifying effect, too.

Therefore, as shown in FIG. 5, if one operative under the foregoing principle is used as the ion generator 230, a dust collecting plate 235 may be further provided.

Figure 6:
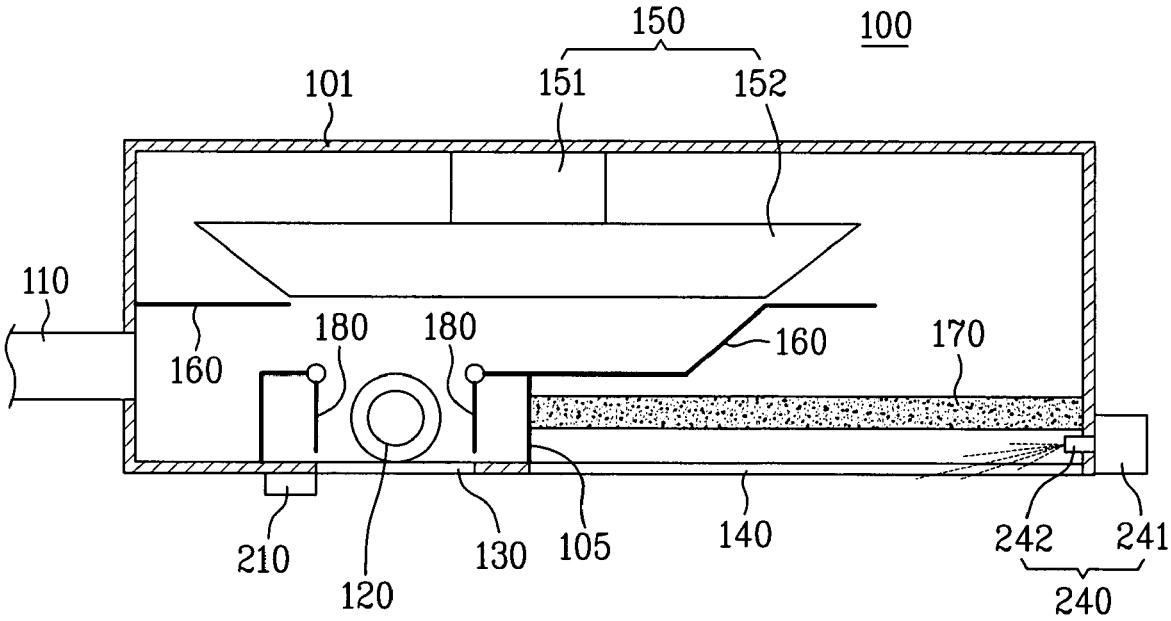
FIG. 6 illustrates a section of an air purifier in accordance with a fourth preferred embodiment of the present invention, schematically.

Referring to FIG. 6, the terpene generator 240 is provided to the case 101, particularly, between the filter 170, and the outlet 140, for supplying terpene to the air being supplied to the room. The terpene generator 240 has a body 241 provided to an outside of the case 101, and a nozzle 242 inside of the case 101.

The terpene is a main composition of phytoncide which is an aromatic chemical with sterilizing, and insecticide capability emitted for protecting the tree itself from microbes, such as bacteria, and insects. It is known that the terpene has a sterilizing effect, a skin waste secretive effect, and lung and heart function enhancing effect, and stimulates autonomic nerves to comfort mind and body. Breathing of air in a thick forest provides a forest bath effect. This is known to be owing to the terpene in the forest air.

Accordingly, if the terpene generator 240 supplies terpene to the air supplied to the room, the person in the room can have, not only the sterilizing effect, but also the forest bath effect.

In the meantime, the air purifier 100 of the present invention may have, not only the sterilizing part, but also an oxygen generator (not shown), and aroma device (not shown) further provided thereto. The oxygen generator may be mounted at a position the same with the UV lamp 220 and the ion generator 230 shown in FIGS. 4 and 5, or at the same position with the terpene generator 240 shown in FIG. 6.

Once the oxygen generator is provided to the case 101, the oxygen generator supplies fresh oxygen to the air supplied to the room, to improve a room environment, substantially.

The aroma device may be provided at the same position with the oxygen generator. However, for enhancing an aromatic effect, it is favorable that the aroma device is mounted on the same position with the terpene generator 240 for enhancing the aromatic effect.

The aroma device mounted thus emits aroma to the air supplied to the room, to have an effect of removal of bad smell from the room.

Operation of the ventilating and air purifying device 100 of the present invention will be described. For reference, since the air purifier 100 includes an air purifying mode, and a ventilating mode, respective modes will be described.

Referring to FIGS. 2A and 2B, in the air purifying mode, the damper 180 opens a part of the guide duct 160, to make the inlet 130 and the guide duct 160 in communication. In this instance, it is preferable that the valves 111, and 112 in FIG. 1 close the air supply duct 110, and the air discharge duct 120, and fans in the air supply duct 110 and the air discharge duct 120 are not in operation.

Under this state, upon putting the blower 150 into operation, the room air is drawn into the case 101 through the inlet 130, and discharged to the room again through the outlet 140 via the guide duct 160 and the blower 150. In this instance, because the filter 170 in the case 101 removes foreign matters from the air, only purified air is supplied to the room.

Next, referring to FIGS. 3A and 3B, in the ventilating mode, the damper 180 closes a part of the guide duct 160, to isolate the guide duct 160 from the inlet 130 and the air discharge duct 120. In this instance, it is preferable that the valves 111, and 121 in FIG. 1 are opened, to open the air supply duct 110 and the air discharge duct 120, and fans in the air supply duct 110 and the air discharge duct 120 are operated.

Under this state, if the blower 150 is put into operation, the outdoor air is supplied to the case 101 through the air supply duct 110. Then, the outdoor air is supplied to the room through the outlet 140 via the guide duct 160, and the blower 150. In this instance, since foreign matters are removed from the air supplied to the case 101, only purified air is supplied to the room.

Then, the room air is introduced into the inside of the case 101, through the inlet 130. In this instance, since the damper 180 is in a closed position, the room air is discharged to outdoor through the air discharge duct 120.

Thus, all the air supplied to the room is purified by the filter during the air purifying mode and the ventilating mode are progressed. If the sterilizing part described with reference to FIGS. 4~6 is provided to the air purifier 100, the room has sterilized air supplied thereto. Moreover, if the oxygen generator and the aroma device are provided to the air purifier 100, the room is also supplied with fresh oxygen, and aroma, together.

In the meantime, shifting between the air purifying mode and the ventilating mode may be manual or automatic. For an example, if the sensor 210 displays the carbon dioxide content of the air, the damper 180, the valves 111, and 121, and the like may be changed over manually with reference to the displayed data. Opposite to this, if the operation mode is shifted to an automatic mode, the control part changes over the operation of the damper 180, and the valves 111 and 121 with reference to the data measured by the sensor 210.

Thus, the ventilating and air purifying device of the present invention can perform air purifying function and ventilating function effectively only with one unit. For this, since the damper in the case diverts air flow direction, the structure is very simple.

The ventilating and air purifying device of the present invention has to bent flow passages passing through the case, i.e., a bent flow passage for supplying outdoor air to the room, and a bent flow passage for discharging room air to outdoor. According to this, by changing arrangement of the various components to be arranged along the flow direction of air, the device can be made compact.

The provision of the sterilizing part, the oxygen generator, and the aroma device permit to improve a room environment, substantially.

In the meantime, the ventilating and air purifying device of the present invention can remove floating dust in room air effectively because the case is mounted on the ceiling or a wall. Moreover, since access of children is difficult, the device is not liable to damage or out of order.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A ventilating and air purifying device comprising:

a case having a blower therein provided to a ceiling or a wall;

a first flow passage extending through a lateral side of the case to connect an inside of the case and an outdoors, the first flow passage extending through a bottom side of the case to connect an inside of the case and a room, wherein the blower is configured to pass air from the outdoors to the room;

a second flow passage extending through the bottom side of the case to connect the room to the inside of the case, the second flow passage extending through an adjacent side of the case, which extends transverse to the lateral side, to connect the inside of the case to the outdoors; and a damper in the case configured to either isolate the first flow passage from the second flow passage such that outdoor air entering the first flow passage is guided from the outdoors to the blower and room air entering the second flow passage is discharged to the outdoors, or to allow the first flow passage and the second flow passage to communicate such that the room air entering the second flow passage is guided to the blower, wherein the first flow passage crosses the second flow passage when the first and second flow passages are isolated from each other.

2. The device as claimed in claim 1, wherein the first flow passage is bent within the case such that a flow direction of the air entering into the case and a flow direction of the air supplied to the room differ.

3. The device as claimed in claim 1, wherein the second flow passage is bent within the case such that a flow direction of the air entering into the case and a flow direction of the air discharged to the outdoor differ.

4. The device as claimed in claim 1, wherein the blower draws air in an axis direction, and discharges air in a radial direction.

5. The device as claimed in claim 1, further comprising a sensor fitted to the case for measuring carbon dioxide content of the room air.

6. The device as claimed in claim 1, further comprising a sterilizing part provided to the case to sterilize the air supplied to the room.

7. The device as claimed in claim 6, wherein the sterilizing part includes at least one of an ion generator, a UV lamp, and a terpene generator.

8. The device as claimed in claim 1, further comprising an oxygen generator provided to the case that supplies oxygen to the air supplied to the room.

9. The device as claimed in claim 1, further comprising an aroma device provided to the case that emits aroma to the air supplied to the room.

10. The device as claimed in claim 1, further comprising a pre-filter provided between the blower and the filter.

11. A ventilating and air purifying device comprising:

a case provided to a ceiling or a wall having an inlet, and an outlet in communication with a room;

an air supply duct provided in a lateral side of the case to introduce air from an outdoors to an inside of the case, an air discharge duct provided in an adjacent side of the case, which extends transverse to the lateral side of the case, to discharge air from the inside of the case to the outdoors;

a blower in the case that forces the air introduced into the case to move toward an outlet;

a filter in the case that purifies the air supplied to the room through the outlet;

a guide duct in the case that guides the air introduced into the case to the blower; and a damper in the case configured to either isolate the inlet from the guide duct or to allow the inlet and the guide duct to communicate, wherein a path of the air introduced from the outdoors to an inside of the case crosses a path of the air discharged from an inside of the case to the outdoors, when the air supply duct and air discharge duct are isolated from each other.

12. The device as claimed in claim 11, wherein the blower draws air in an axial direction, and discharges air in a radial direction.

13. The device as claimed in claim 11, wherein at least one of the air supply duct and the air discharge duct is connected to a surface adjacent to a surface having the inlet and the outlet formed therein.

14. The device as claimed in claim 11, wherein the air discharge duct is provided to draw air between the inlet and the guide duct.

15. The device as claimed in claim 11, wherein the damper is provided to open/close a part of the guide duct in communication with the inlet.

16. The device as claimed in claim 11, further comprising a valve provided to at least one of the air supply duct and the air discharge duct to open/close the air supply duct or the air discharge duct.

17. The device as claimed in claim 11, further comprising a conductive heat exchanger which is configured to allow the air supply duct and the air discharge duct to cross such that indirect heat exchange of air flowing in the air supply duct and the air discharge duct occurs.

18. The device as claimed in claim 11, further comprising at least one branch duct branched from at least one of the air supply duct and the air discharge duct in communication with the room.

19. The device as claimed in claim 11, further comprising a sensor fitted to the case to measure carbon dioxide content of the room air.

20. The device as claimed in claim 11, further comprising a sterilizing part provided to the case to sterilize the air supplied to the room.

21. The device as claimed in claim 20, wherein the sterilizing part includes at least one of an ion generator, a UV lamp, and a terpene generator.

22. The device as claimed in claim 11, further comprising an oxygen generator provided to the case that supplies oxygen to the air supplied to the room.

23. The device as claimed in claim 11, further comprising an aroma device provided to the case that emits aroma to the air supplied to the room.

* * * * *